United States Patent [19]

Lindman

[11] 3,952,363

[45] Apr. 27, 1976

[54] VACUUM CLEANER NOZZLE

[75] Inventor: Fred Henry Lindman, Hagersten, Sweden

[73] Assignee: Aktiebolaget Electrolux, Stockholm, Sweden

[22] Filed: Nov. 4, 1974

[21] Appl. No.: 520,668

[30] Foreign Application Priority Data

Nov. 8, 1973 Sweden ..... 7315151

[52] U.S. Cl. ..... 15/373

[51] Int. Cl.[2] ..... A47L 9/06

[58] Field of Search ..... 15/355, 365, 368, 371, 15/373

[56] References Cited

UNITED STATES PATENTS

| | | | |
|---|---|---|---|
| 2,597,808 | 5/1952 | McQuilkin | 15/373 |
| 2,655,682 | 10/1953 | McCarthy | 15/373 |
| 3,040,367 | 6/1962 | Hellstrom | 15/373 X |
| 3,727,263 | 4/1973 | Johansson | 15/373 |

*Primary Examiner*—Stanley N. Gilreath
*Assistant Examiner*—C. K. Moore
*Attorney, Agent, or Firm*—Alfred E. Miller

[57] ABSTRACT

A vacuum cleaner nozzle having an internal brush which is selectively elevated from or lowered to rug engaging position. The actuating means for the brush constitutes two operating devices located, as viewed from the operator, on the left hand side of the nozzle housing and accessible from the exterior thereof. The operating devices are connected to cam members in the form of rollers which co-act with the brush support to effect the vertical movement of the brush.

8 Claims, 3 Drawing Figures

VACUUM CLEANER NOZZLE

BACKGROUND OF THE INVENTION

Vacuum cleaner nozzles are known having rug and floor engaging brushes which are vertically movable under spring action from a position whereby the bristles of the brush rest on a rug or floor to a position in which the bristles are lifted from the surface being cleaned.

However, nozzles of this type are difficult to manipulate since the operating means for the brush is disposed on either side of the nozzle tube. When a right-handed person operates the nozzle together with the wand of a vacuum cleaner of this type the user's foot is obstructed by the nozzle tube projecting upwardly and connected at its lower end to the nozzle.

In order to overcome the aforesaid disadvantage, both actuating means for the nozzle brush are disposed on the same side, being the left side of the nozzle assembly.

It is an object of the present invention to provide a camming device comprising two rollers and linked pivotable arms having activating members which are accessible from the exterior of the nozzle housing.

A further object of the present invention is to provide a rugged assembly for moving a nozzle brush to or from engagement with a rug or floor surface.

The invention will now be more fully described with reference to the accompanying drawings, in which.

DESCRIPTION OF THE PREFERRED EMBODIMENT

Figure 1:
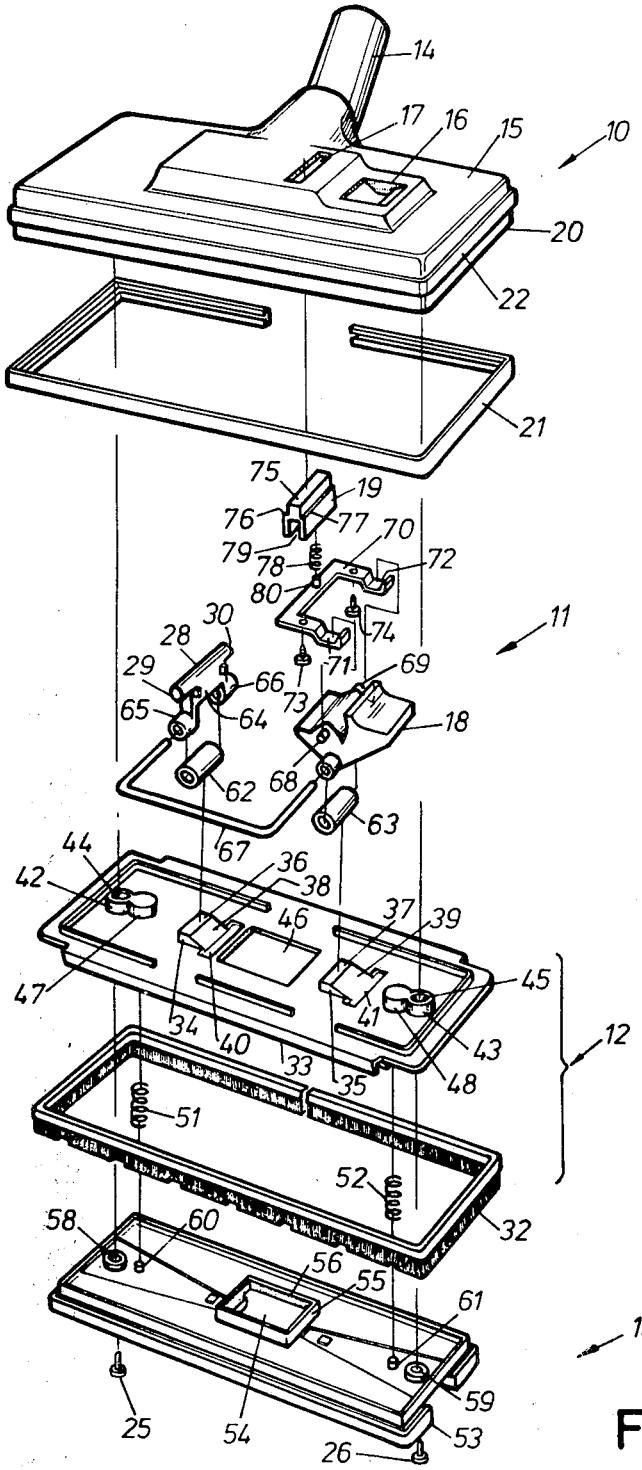
FIG. 1 is an exploded perspective view of the vacuum cleaner nozzle assembly.

As seen in FIG. 1, the present vacuum cleaner nozzle comprises four main sections, i.e., casing or housing 10, an operating device 11, a bristle plate 12 and a bottom plate 13.

The sections mentioned above co-act in a manner hereinafter described. The casing 10, and elongated tube 14 are pivotally connected in a manner known in the art. The tube 14 conducts the dust laden air to a vacuum cleaner hose (not shown) and thereafter to a fan unit (not shown). The dust is generally deposited in a disposable bag.

Figure 2:
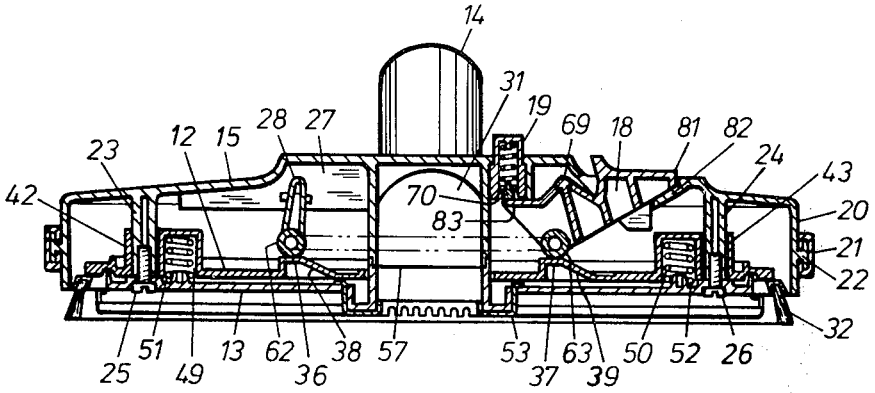
FIG. 2 is a sectional view, partly in elevation, of the nozzle with the bristles of the nozzle brush shown in a lowered position
Figure 3:
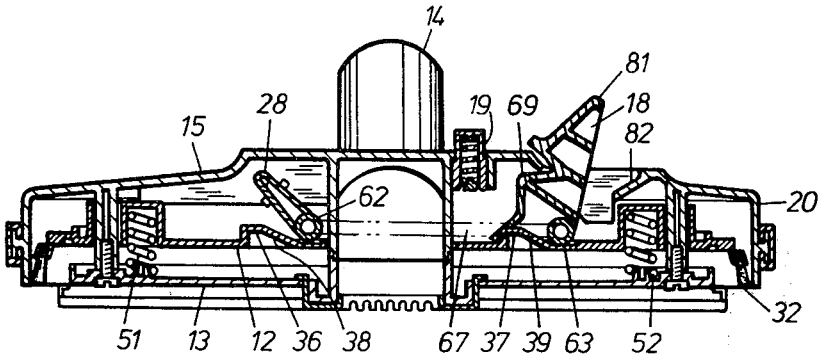
FIG. 3 is a similar sectional view, partly in elevation, in which the bristles of the nozzle brush are shown in an elevated position.

In the upper part of the casing 10 two openings 16 and 17 are shown. The operating means 18 and 19 of the operating device 11 are accessible from the outside since they protrude through their respective openings. As seen in the figures, casing 10 is provided with vertical wall portions 20 resulting in a box-shaped structure. A circumferential edge protector 21 of resilient material is secured to the wall portions 20 by means of a flange 22 having an internal T-shaped configuration, as seen in FIGS. 2 and 3. This arrangement prevents damage to either furniture, or the nozzle, during cleaning. As seen in FIGS. 2 and 3, the casing 10 is provided with two spaced, downwardly extending hollow pins 23 and 24 that extend from the undersurface of the upper part 15 of casing 10. The lower open parts of the pins having internally threaded portions which are adapted to receive screws 25 and 26. The latter retains the bottom plate 13 firmly secured to the casing 10.

As seen in FIGS. 2 and 3 two separate, parallel plates 27 are shown extending vertically (only one of which is shown). The plates 27 are provided with grooves for receiving the shaft 28 of the operating device 11. The ends 29 and 30 of device 11 rest in the grooves (not shown). A passage 31 is shown extending directly under the tube 14. The tube and passage are sealed from the rest of the casing and extend to the lower part of the nozzle (FIGS. 2 and 3).

Referring to FIG. 1, the plate 12 includes an elongated, rectangular-shaped ring 32 of bristles supported by a strip which is mounted in the interior of the nozzle casing 10 and inside vertical wall portions 20. The strip is clamped between the downturned flanges 33 of the plate 12 thereby retaining the ring of bristles 32 on the plate 12. However, if the bristles of the brush become worn, the ring 32 can be easily and rapidly exchanged for a new ring by sliding the ring 32 out from the flanges 33 and sliding a new ring therein.

Two spaced shoulders 34 and 35 are shown, each having a horizontal portion 36, 37 respectively and an inclined portion 38, 39 respectively which is sloped downwardly from the respective horizontal portion toward the plate 12. The lower end of inclined portion 38 ends in a shallow cavity 40 while the lower end of inclined portion 39 terminates in a shallow cavity 41. On opposite ends of the plate 12 are holes 44 and 45 which pass therethrough and are surrounded by sleeves 42 and 43 respectively. As seen in FIG. 1, the screws 25 and 26 are inserted through the respective holes thereby permitting the plate 12 to move freely vertically.

The plate 12 is provided in the center thereof with a through rectangular-shaped hole 46. Moreover, located adjacent to each sleeve 42 and 43 and on the top surface of the plate 12, are upstanding cylindrical portions 47 and 48 having internally bored recesses 49 and 50 respectively. These recesses are accessible from the underside of the plate and each is so constructed as to accommodate a spring 51 or 52 resting at the other end on the bottom plate 13 and normally urging the plate 13 upwardly.

The bottom plate 13 is preferably fabricated of plastic and has a metal plate 53 abutting the base surface. This base surface of the plate 13 and the metal plate 53 together form a suction chamber which, by means of a central rectangular hole 54 in the plate 13 and the walls 55 surrounding said hole, communicate with the sealed passage 31. Therefore, when the brush plate 12 moves vertically, the walls of the hole 46 slide intimately along the walls 55. In order to prevent air from being drawn in between the upper edges 56 of the walls 55 and the corresponding abutting surfaces 57 of the walls surrounding the passage 31, the walls are accurately sealed one against the other. As seen in FIG. 1, the bottom plate 13 has two spaced through holes 58 and 59, each accommodating one of the screws 25 or 26 respectively. The heads of the screws are adapted to abut the underside of the bottom plate thereby locking it to the casing 10 by being screw-connected to the respective cylindrical pins 23 and 24. The bottom plate 13 is also provided with two upstanding short pins or stub shafts 60 and 61 which extend vertically upwardly. An end of each of the springs 51 and 52 respectively overlies the corresponding short pins thereby maintaining the springs 51 and 52 in their proper place.

The operating device assembly 11 is intended to move the brush plate 12 vertically to either lift or lower the same. This device comprises two cam rollers in the form of sleeves 62 and 63. One cam roller is fitted in a linked arm in the form of a rocker device 64 and the other cam roller is assembled in a linked arm comprising the previously mentioned operating means 18. The rocker device 64 has two co-axial, separated sockets 65 and 66 between which the sleeve 62 is mounted. The diameters of the sleeve and the sockets are generally equal. The sleeve 63 is mounted on the operating means 18. Furthermore, the latter is interconnected to the shaft 28 or the rocker device 64 by means of a U-shaped bracket 67, the legs of which are inserted respectively in the sockets 65, 66 of the rocker device 64 and an opening in the operating means 18, as well as through the sleeves 62 and 63 themselves. It should therefore by apparent that the sleeves, the rocker device, and the operating means 18 are all pivotally interconnected. The journals or spindles 68 and 69 projecting in opposite directions on the operating means 18 support the latter in the casing 10 by means of a U-shaped holder 70, the legs of which have recesses 71 and 72 that are adapted to retain the journals 68 and 69. The U-shaped holder 70 is secured to the upper part of the casing 10 by means of screws 73 and 74.

The second operating means 19 is provided with a generally flat upper portion 75 which projects through the casing 10, as well as two flanges 76 and 77 which rest on the inside of the upper part 15 of the casing 10 and are pressed into engagement with the casing 10 by means of a coil spring 78 (FIGS. 2 and 3). The coil spring 78 is captured between a slot 79 in the operating means 19 and an upstanding short pin or shaft 80 projecting from the U-shaped holder 70.

The nozzle operates in the following manner: It is assumed first that the nozzle is in the position shown in FIG. 2 in which the brush plate 12 is in its lowered position, or in floor or rug engaging condition. The cylindrical sleeves 62 and 63, respectively, rest on and abut the horizontal portions 36 and 37 respectively of the shoulders 34 and 35. It will be noted that the centers of the sleeves are a little to the left and below their pivotal centers 28, 68 and 69 whereby these sleeves assume a stable position of equilibrium, due to a toggle effect. In this condition, as seen in FIG. 2, an outer portion 81 of the operating means 18 rests against a lug 82 in the upper part 15 of the casing 10 thereby preventing the sleeves 62 and 63 from pivoting further in a clockwise direction under the action of the springs 51 and 52.

If it is desired to elevate the bristle ring 32 and retract the same into the nozzle, as seen in FIG. 3, the second operating means 19 is depressed and the bottom part acts on the inner part 83 of the operating means 18 so that the sleeves 62 and 63 will turn in a counterclockwise direction about their pivotal centers 28, 68 and 69. When the sleeves 62 and 63 have reached a position to the right of their pivoting centers, i.e. where the horizontal portions 36 and 37 pass into the inclined portions 38 and 39 of the shoulders 34 and 35 respectively, the springs 51 and 52 urge the bristled ring 32 and together with the brush plate 12 upwardly to its upper position. The operating means 18 then assumes the position shown in FIG. 3, and the sleeves 62 and 63 come to rest in their respective cavities 40 and 41.

If it is desired to move the bristle ring downward to the base surface, the outer portion 81 of the operating means 18 is depressed, for example by foot.

Thus, by rolling the sleeves 62 and 63 up the inclined portions 38 and 39 to rest on the horizontal flat portions 36 and 37, the bristled ring of the brush plate 12 is urged downwardly to the position shown in FIG. 2.

What is claimed is:

1. A vacuum cleaner nozzle provided with a spring-urged brush that is movable from a first position in engagement with the surface to be cleaned to a second position out of engagement with said surface to be cleaned and vice-versa comprising; a housing, means at the bottom of said housing for confining said brush in said housing but permitting limited movement therein, a cam device including spaced, pivotable roller members, a bracket interconnecting said roller members, said brush including a plate provided with brush bristles, the upper surface of said plate being provided with spaced, shaped shoulder elements that are each adapted to be engaged by a corresponding roller member, said shoulder elements being part of said cam device, linking means joining each roller to said nozzle, the linking means of one of said rollers having an arm provided with a first foot actuated operating means for moving said roller members on said shaped shoulders whereby said brush is moved to a selected position in which a portion thereof projects outside of said housing, and a second foot actuated operating means accessible from the outside of said housing acting upon an inner part of the linking means for moving said roller members on said shaped shoulders whereby said brush is moved to another position located within the interior of said housing.

2. A nozzle as claimed in claim 1, wherein said first operating means is located in close proximity to said second operating means.

3. A nozzle as claimed in claim 1, wherein both said first and second operating means are located on the left hand side of said nozzle upon being viewed by the user when the nozzle is an active condition engaging the surface to be cleaned.

4. A nozzle as claimed in claim 1 further comprising a U-shaped member functioning as a limiting stop for said second operating means, said first operating means having oppositely disposed journals, the legs of said U-shaped member having recesses which act as bearing surfaces for the journals of said first operating means.

5. A nozzle as claimed in claim 4 further comprising an helical spring clamped between said U-shaped member and said second operating means for urging at least a part of the latter outside of said nozzle.

6. A nozzle as claimed in claim 1, wherein said second operating means includes a generally horizontal portion having two spaced plates extending vertically downwardly from said horizontal portion in the interior of said housing which engages said inner part of the linking means when said horizontal portion is depressed a predetermined distance.

7. A nozzle as claimed in claim 1, wherein each of said shoulder elements has a flat top surface and a connected sloping surface, a cavity adjacent to the bottom of said sloping surface, each of said roller members in one position of said brush engaging an adjacent flat top surface, and in the other position of said brush being rolled down said sloping surface into an adjacent cavity.

8. A nozzle as claimed in claim 1, wherein said bracket is U-shaped, and one of the legs of said bracket additionally functioning as the central shaft for one of said roller members, while a second leg additionally functions as the central shaft for a second one of said roller members.

* * * * *